US006237197B1

(12) United States Patent
Donahue

(10) Patent No.: US 6,237,197 B1
(45) Date of Patent: May 29, 2001

(54) GOLF CART BUCKLE LEVER RETAINING CLIP

(76) Inventor: Richard Cahill Donahue, 1750 21st Ave., San Francisco, CA (US) 94122

( * ) Notice: Subject to any disclaimer, the term of this patent is extended or adjusted under 35 U.S.C. 154(b) by 0 days.

(21) Appl. No.: 09/301,638

(22) Filed: Apr. 28, 1999

(51) Int. Cl.[7] ..... A44B 11/00

(52) U.S. Cl. ..... 24/166; 24/167; 24/170; 24/545; 24/561

(58) Field of Search ..... 224/572; 70/18, 70/58, 203, 212; 280/DIG. 5; 24/166, 167, 170, 191–193, 302, 298, 545, 563, 561, 562, 556, 555

(56) References Cited

U.S. PATENT DOCUMENTS 566,932 * 9/1896 Patrick .
1,490,871 * 4/1924 Wagner .
2,931,086 * 4/1960 Rose .
3,252,193 * 5/1966 Matthews et al. .
3,484,908 * 12/1969 Lamb .
4,057,983 * 11/1977 Morgan .
4,216,665 * 8/1980 McKelvey .
4,639,978 * 2/1987 Boden .
4,685,315 * 8/1987 Comolli .
4,823,568 * 4/1989 Rogers et al. .
4,896,519 * 1/1990 Pitts .
4,924,615 * 5/1990 Ives .
5,052,604 * 10/1991 Tourangeau .
5,358,019 * 10/1994 Sumner, III .
5,727,642 * 3/1998 Abbott .
5,970,586 * 10/1999 Demel et al. .

FOREIGN PATENT DOCUMENTS

249533 * 4/1948 (CH) ..... 70/18
2443946 * 8/1980 (FR) ..... 70/203

* cited by examiner

*Primary Examiner*—James R. Brittain
(74) *Attorney, Agent, or Firm*—Risto A. Rinne, Jr.

(57) ABSTRACT

An apparatus for use in securing a golf cart buckle lever in a closed position includes a clip having a substantially U-shaped body that can secure the buckle lever in a closed position. The U-shaped body includes a front and a rear member that are disposed in a spaced-apart parallel relationship and a perpendicular top member which is disposed and attached intermediate thereto. An inner member that is parallel to the front member is disposed intermediate the front and rear members and is attached to the front member by a pair of inclined members disposed on opposite ends thereof. A pair of apertures are adapted to receive a locking device and a tether is provided to secure the clip to the golf bag.

18 Claims, 2 Drawing Sheets

GOLF CART BUCKLE LEVER RETAINING CLIP

BACKGROUND OF THE INVENTION

1. Field of the Invention

The present invention, in general, relates to belts and buckles and, more particularly, to devices that maintain a buckle lever in a closed position so as to better secure a belt that holds a bag of golf clubs on a golf cart.

Golf carts include a platform that is usually disposed behind the cart and which is useful for placing the bottom of one or more golf bags thereon. An elevated U-shaped support bracket is disposed above the platform and includes a belt and a buckle attached thereto. The belt is normally passed around the outside of the golf bag or bags and then into the buckle. The belt is tightened as desired and urges the golf bags against the support bracket where they are retained in position.

The buckle includes a pivotable lever of some sort, typically with a cam attached thereto that, when tightened, presses upon (binds) and secures the belt in place within the buckle, thereby also retaining the golf bag (or bags) on the platform in an upright position.

Unfortunately, a problem all too well known by golfers, is that the pivotable lever sometimes loosens (opens) during transport, the belt dislodges from the buckle, and the golf bag or bags fall to the ground as the golf cart is driven.

The lever can loosen for any number of reasons. A few of the more common reasons include simply not fully closing the lever tight against the buckle when the golf bags are first secured in place. If conversation is transpiring, for example, the user may not be aware that he or she did not fully close the lever. Either tension between the lever and the belt or a slight jar during use can cause the partially closed lever to spring from the partially closed position and pivot into an open position.

Another reason that the lever can loosen is that, during use, the belt is often tightened nearly the same amount each time and so it may tend to wear in certain general areas along its length. This is because most golf bags tend to be about the same diameter and, depending upon the number of bags placed on the platform, the belt will often be tightened to either of a few common positions.

Also, the cam portion of the buckle will wear from normal repeated use and become increasingly loose. As the lever is held in the closed position by tension applied to the belt which is in turn pressed against the back of the buckle, any slack between the cam portion and the belt will tend to cause the lever to open during transport.

Another common reason that the lever can pivot open is because it can be contacted by a branch of a tree or a bush during transport which can easily flip it open unknown to the operator of the golf cart, as would be any of the conditions as described hereinabove as well as for certain other reasons not described herein.

When the pivotable lever swings open the belt is no longer retained and is able to be easily pulled out of a position of cooperation with the buckle. As the golf cart is driven, normal shaking and vibrations will cause the golf bags to jostle around and to pull the belt out of the buckle. Once the belt has been pulled out of the buckle the golf bags can fall off of the platform and onto the ground.

Often the surface that the golf cart is driven upon is either formed from poured concrete or is made of asphalt, either of which provide a potentially damaging hard and abrasive surface upon which the golf bag and the golf clubs contained therein may land.

Needless to say, the risk of damage to expensive golf clubs is great and the sound of a golf bag falling on the ground while in a moving golf cart is indeed a painful one for any golf club owner to hear.

The problem itself is not especially easy to solve. While there are a relatively few primary manufacturers, there are nevertheless numerous manufacturers of golf carts and platforms and their associated brackets. There are numerous belts and buckles in existence as well, not all of which are dimensionally the same. Therefore an ideal solution must take into account the differences in manufacture that currently exist amongst the most common products that are currently available.

A further obstacle needing to be overcome is that any potential solution intended to keep the buckle closed must also be easy to apply or golfers will simply not take the time or exert the effort necessary to properly install it.

Another requirement is that any solution must also stay in position until the user deliberately wishes to remove it, at which time it should be easily removable.

Furthermore, it must be kept handy. If a solution is difficult to find, then golfers will likely not take the time to find and use it even though it may be especially easy to use once found.

There is another problem associated with the storage of golf bags on a golf cart. Often golfers will stop, at a club house for example, and get food or drink before continuing play or returning the golf cart back to its drop-off location. Sometimes when they come back to the golf cart, they find that their golf bags have been stolen along with all of their expensive golf clubs. Therefore, an ideal solution would also provide for the more secure storage of golf bags while they are on the golf cart.

Any prospective solution, ideally, should also be inexpensive to manufacture and therefore, to purchase.

Even more ideal, it would be free or nearly so to the end user. It is well known that golf as a sport is experiencing a recent tremendous growth of popularity. There are many manufacturers of various types of golf equipment, such as golf clubs, golf bags, golf shoes, golf carts, and various other golfing and related accessories eager for opportunities to advertise their companies in ways that reach other golfers.

Therefore, if a golf cart buckle lever retaining clip could be used for advertising, there would be added incentive for the various manufacturers to provide it either free with other purchases, for example, or at very low cost to the golfer. As such, the ideal solution would also provide consideration of the needs of various manufacturers for advertising.

Accordingly there exists today a need for a golf cart buckle lever retaining clip that helps to secure a buckle lever in a closed position, is inexpensive, is suitable for use with a variety of buckles, is easy to apply, stays in place once it is applied, can be used to advertise product, is easy to remove, is easy to find, and which can, if desired, improve security when storing golf bags on a golf cart.

Clearly, such an apparatus would be a useful and desirable device.

2. Description of Prior Art

Retaining clips and the like are, in general, known. For example, the following patents describe various types of these devices:

U.S. Pat. No. 483,299 to Cadwell, Sep. 27 1892;

U.S. Pat. No. 1,475,974 to Torrey, Dec. 4, 1923;

U.S. Pat. No. 1,490,871 to Wagner, Apr. 15, 1924;

U.S. Pat. No. 1,682,536 to Otten, Aug. 28, 1928;

U.S. Pat. No. 2,869,198 to Clevett, Jr., Jan. 20, 1959;

U.S. Pat. No. 4,214,686 to Dostourian, Jul. 29, 1980;

U.S. Pat. No. 5,044,049 to Owens et al., Sep. 3, 1991; and

U.S. Pat. No. 5,495,644 to Mesher et al., Mar. 5, 1996.

While the structural arrangements of the above described devices, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a golf cart buckle lever retaining clip that is inexpensive to produce.

It is also an important object of the invention to provide a golf cart buckle lever retaining clip that can be used with a variety of belts and buckles.

Another object of the invention is to provide a golf cart buckle lever retaining clip that is easy to apply.

Still another object of the invention is to provide a golf cart buckle lever retaining clip that is easy to remove.

Still yet another object of the invention is to provide a golf cart buckle lever retaining clip that stays in place once it is applied.

Yet another important object of the invention is to provide a golf cart buckle lever retaining clip that is convenient and therefore easy to find.

Still yet another important object of the invention is to provide a golf cart buckle lever retaining clip that can help improve security of golf bags which are placed on the golf cart.

One yet further especially important object of the invention is to provide a golf cart buckle lever retaining clip that provides a visible surface during its use upon which manufacturers may advertise.

One additional and especially important object of the invention is to provide a golf cart buckle lever retaining clip that includes a structure adapted to cooperate with a wide variety of golf cart buckle levers that are currently in use.

Briefly, a buckle lever retaining clip apparatus for use with a belt and buckle on a golf cart that helps to secure a buckle lever in a closed position and which is constructed in accordance with the principles of the present invention has a substantially U-shaped body with a front member and an opposite rear member, both of which are substantially planar members. An inner member that is substantially planar and has a smaller height than the front member is disposed in parallel alignment with respect to the front member a predetermined distance from the front member in a direction that is toward the rear member. A first inclined member and a second inclined member are disposed intermediate the inner member at opposite ends thereof and the front member. The first and second inclined members attach the inner member to the front member. The front member includes a width that is greater than that of the rear member and a height that is comparable to that of the rear member. A top member is disposed perpendicular with respect to the front and rear members and intermediate with respect thereto. Together the front member, the rear member, the inner member, the first and second inclined members, and the top member form a substantially U-shaped body of the clip. At an end opposite the top a first lip is attached to the front member and a second lip is attached to the rear member. The first and second lips are generally disposed parallel with respect to the top member and extend from the front and the rear members toward the inside of the clip. The first lip is preferably of greater depth than is the second lip. A first arcuate member that includes a flat end and an opposite curved end is attached at the flat end to the first lip at an edge opposite to where the first lip is attached to the front member. The first arcuate member extends away from the top and is parallel with respect to the front member. A first aperture is provided through the curved end. A second arcuate member that includes a second flat end and a second opposite curved end is attached at the second flat end to the second lip at an edge opposite to where the second lip is attached to the rear member. The second arcuate member extends away from the top and is parallel with respect to the rear member. A second aperture is provided through the second curved end so as to align with the first aperture. The top includes a protrusion attached thereto having a third aperture to which a tether is attached. The clip is constructed of a material that allows for sufficient flexing so that it can be readily placed over the buckle or removed therefrom.

DETAILED DESCRIPTION OF THE INVENTION

Figure 1:
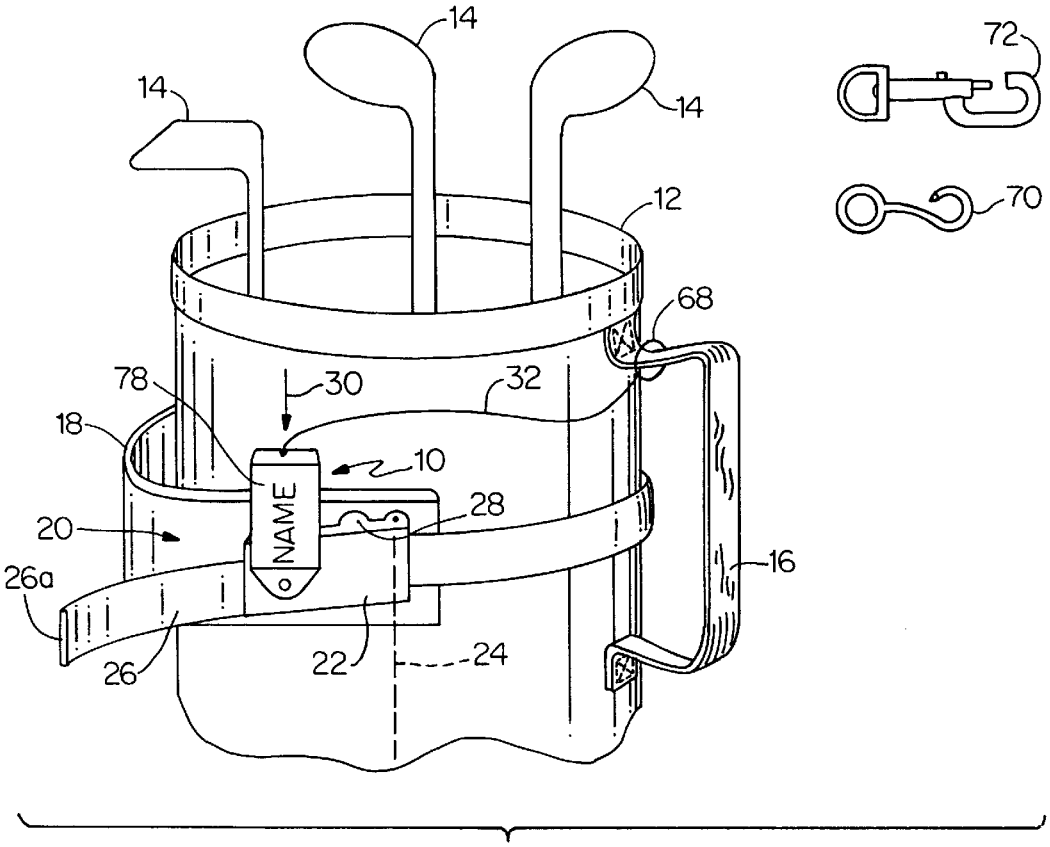
FIG. 1 is a partial view in perspective of a golf bag adjacent to a U-shaped bracket secured by a belt and a buckle with the inventive clip partially attached thereto and secured to the golf bag by a tether. Two alternative ways of attaching the tether to the golf bag are also shown.
Figure 2:
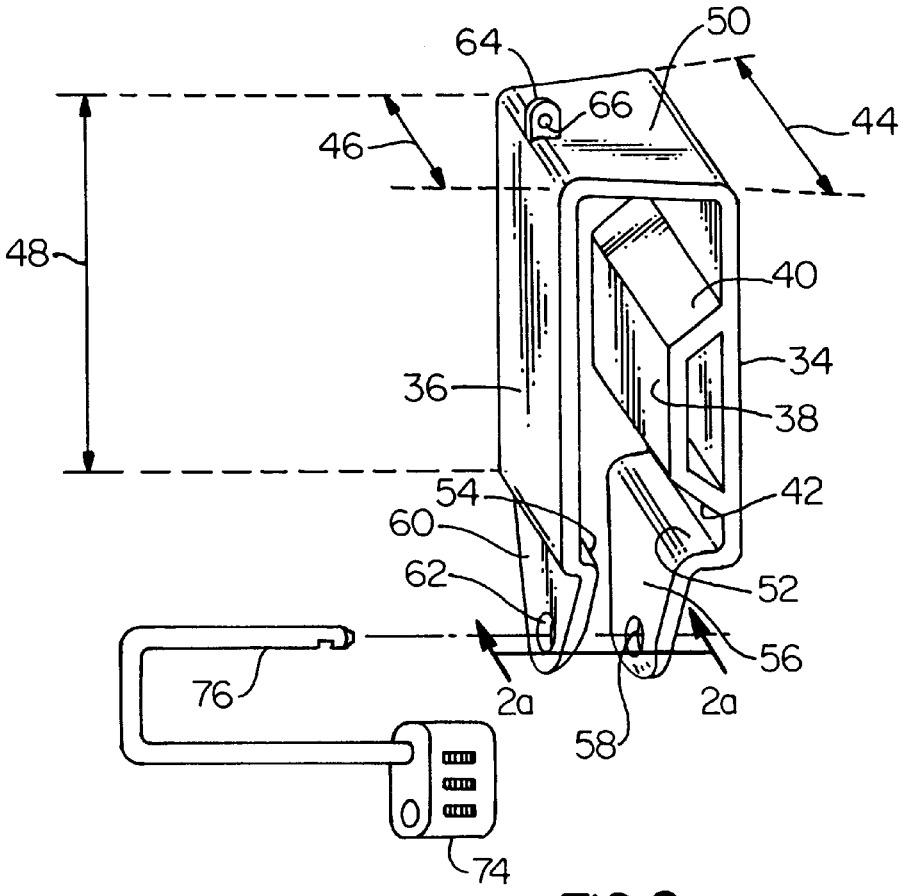
FIG. 2 is a view in perspective of the inventive clip and an optional lock that is ready for insertion into a pair of apertures.
Figure 2A:
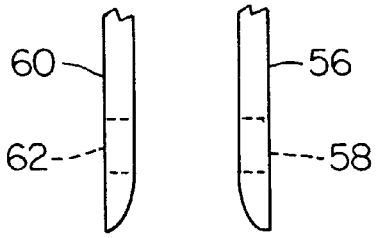
FIG. 2*a* is a partial view taken along the line "2*a*—2*a*" of FIG. 2.

Referring as needed to both FIG. 1 and FIG. 2 is shown, a buckle lever retaining clip, identified in general by the reference numeral 10 and hereinafter referred to as "the clip 10".

A golf bag 12 contains an assortment of various golf clubs 14. A carrying handle 16 is attached to the golf bag 12. A portion is shown of a U-shaped bracket 18 that is attached to a golf cart (not shown). The U-shaped bracket 18 is commonly a metallic structure.

A buckle, identified in general by the reference numeral 20, is attached to the bracket 18 and includes a buckle lever 22 that is adapted to pivot about an axis 24.

A belt 26 that is typically attached to the bracket 18 either in the middle or at a first end and a portion of the belt 26 loops around the golf bag 12. The belt 26 preferably is placed so that it passes intermediate the golf bag 12 and the handle 16. This prevents removing the golf bag 12 from the bracket 18 as long as the belt 26 is secured in position.

A second end 26*a* of the belt 26 passes through the buckle 20, and is secured in position by the buckle lever 22 when the buckle lever 22 is maximally pivoted toward the bracket 18 as is shown in FIG. 1. When the buckle lever 22 is closed it is disposed as close to the bracket 18 as possible where it is substantially parallel with respect to the bracket 18.

The buckle lever 22 includes a cam portion 28 that bears upon the belt 26 and presses it against the remainder of the buckle 20. Alternatively, if a modified bracket (not shown) is used with a modified buckle (not shown), the buckle lever 22 may press the belt 26 directly against the modified bracket (instead of the buckle 20) to secure it in position.

The clip 10 in the FIG. 1 drawing is being applied in the direction of a first arrow 30 to secure the buckle lever 22 in a closed position, and therefore also the belt 26 to the buckle 20. The clip 10, which is described in greater detail hereinafter, is placed down from the top of the bracket 18 so as to straddle the bracket 18, the buckle 20, and the buckle lever 22 supplying a force that urges them together or, alternatively, by creating a force that resists any attempt to pivot the buckle lever 22 about the axis 24 and into a more open position.

A tether 32 is attached to both the clip 10 and to the golf bag 12 and is described in greater detail hereinafter. The tether 32 prevents loss of the clip 10 and keeps it readily accessible for convenient use.

The clip 10, in general, includes a substantially U-shaped body assembly, the construction of which is described in greater detail hereinafter. The clip 10 includes a front member 34 and an opposite rear member 36, both of which are substantially rectangular planar members.

An inner member 38 is also substantially planar and rectangular in shape but it includes a smaller height than the front member. The inner member 38 is disposed in parallel alignment with respect to the front member 34 intermediate the front member 34 and the rear member 36 at a predetermined distance from the front member 34.

A first inclined member 40 and a second inclined member 42, each of which are also substantially rectangular planar members, are disposed intermediate the inner member 38 at opposite ends thereof and are attached to both the inner member 38 and to the front member 34 and therefore, serve to attach the inner member 38 to the front member 34.

The front member 34 includes a width, identified by arrow 44 that is greater than the width of the rear member 36, identified by arrow 46, and a height that is comparable to that of the rear member 36, identified by arrow 48. The preferred dimension for the width of the front member 34 (arrow 44) is 2.2 inches and for the width of the rear member 36 (arrow 46) is 1.8 inches. The preferred height arrow 48) for the front and rear members 34, 36 is 2.45 inches (outside dimension).

These dimensions have been determined to optimally cooperate with the maximum range of products that are found on the golf carts which are presently in use.

A top member 50 is a substantially planar member and if viewed from the top would be trapezoidal in shape with the larger leg attached to the front member 34 and the smaller parallel leg attached to the rear member 36.

The top member 50 is perpendicular with respect to the planar alignment of the front member 34 and the rear member 36 and is disposed intermediate with respect thereto. Together, the front member 34, the rear member 36, the inner member 38, the first and the second inclined members 40, 42, and the top member 50 form a substantially U-shaped body assembly of the clip 10.

At an end opposite the top member 50, a first lip 52 is attached to the front member 34 and a second lip 54 is attached to the rear member 36. The first and second lips 52, 54 are generally disposed parallel with respect to the planar orientation of the top member 50 and extend from the front member 34 and from the rear member 36 toward each other and toward the inside of the clip 10. The first lip 52 is preferably of a greater depth than is the second lip 54.

A first arcuate member 56 is also a substantially planar member that includes a flat end and an opposite curved end and is attached at the flat end to the first lip 52 at an edge opposite to where the first lip 52 is attached to the front member 34. The first arcuate member 56 extends away from the top member 50 and is disposed in parallel planar alignment with respect to the front member 34 when the clip is at rest. A first aperture 58 is provided through the curved end of the first arcuate member 56.

A second arcuate member 60 is also a substantially planar member that includes a second flat end and a second opposite curved end. The second arcuate member 60 is attached at the second flat end to the second lip 54 at an edge opposite to where the second lip 54 is attached to the rear member 36. The second arcuate member 60 extends away from the top member 50 and is disposed in parallel planar alignment with respect to the rear member 36 when the clip 10 is at rest.

A second aperture 62 is provided through the second curved end of the second arcuate member 60 so as to align with the first aperture 58.

The top member 50 includes a protrusion 64 attached thereto having a third aperture 66 to which the tether 32 is attached at a first end thereof.

The opposite end of the tether includes a variety of possible ways of attaching it where desired to the golf bag 12. A ring 68, similar to a key ring, is shown disposed around the handle 16.

The purpose is to maintain the clip 10 in an obvious and handy position for use. If it must be stowed away, such as in a pocket (not shown) of the golf bag 12, it is not likely to be often used. However, if it is allowed to hang suspended by the tether 32 in a plainly visible and convenient fashion, it is quite likely to be used. In fact, making the clip 10 as visible as possible is preferred and bright colors are envisioned for this purpose.

Alternative methods to attach the tether 32 to the golf bag 12 include the use of an S-hook 70, that is bent to secure it in position and a variety of fastening devices 72, any of which would be attached to the opposite end of the tether 32 and then to the bag 12.

The first arcuate member 56 and the second arcuate member 60 need not be parallel with respect to each other when the clip 10 is at rest but may be designed so as to include a slight opening angle for ease of use when applying the clip 10 over the buckle 20. As such, the ends of the first arcuate member 56 and the second arcuate member 60 that are proximate the first and second apertures 58, 62 would be disposed further apart with respect to each other than are the flat and the second flat ends.

A lock 74 is provided, as desired, either with the clip 10 or as an accessory item. The lock 74 includes a bolt 76 that passes through the first and the second apertures 58, 62 and is secured in place within the body of the lock 74 as is well known in the locking device arts. The lock 74 includes either a key or combination lock mechanism to permit opening it when desired.

When the lock 74 is secured, the clip 10 is retained in a position of cooperation about the buckle 20 and is unable to be removed therefrom without the use of force (or picking the lock open). If the belt 26 passes through the handle 16, as shown, the golf bag 12 is also retained in position.

Accordingly, the clip 10 solves the problem caused by the inadvertent opening of the buckle 20 and falling of the golf bag 12 from the cart, but when the lock 74 is used, it also deters theft of the golf bag 12 from the cart. No current method is known to exist that addresses and solves either of these needs. The clip 10 provides the further unexpected benefit of solving both needs.

The preferred material for construction of the clip is a type of plastic that is flexible to a sufficient degree. When operated within normal intended ranges of flex, it is sufficiently elastomeric. The use of injection molded nylon provides a tough durable material well suited for this purpose and having sufficient elastomeric properties.

A first tapered edge 77*a* is attached to the opposite curved end of the first arcuate member 56. A second tapered edge 77*b* is attached to the opposite curved end of the second arcuate member 60. Both the first and the second tapered edges 77*a*, 77*b* are disposed so that the longest side of the first and second arcuate members 56, 60 are on the outside surfaces of the clip 10. This is to facilitate insertion of the clip 10 over the buckle 20 by providing a smooth inclined surface.

Operation: The clip 10 is constructed so as to permit the front and rear members 34, 36 to be flexible enough to open apart and allow passage over the buckle 20 when applying the clip 10 (see arrow 30) or removing it.

In use the belt 26 is drawn tight around the golf bag 12 and is secured by closing the buckle lever 22. The clip is then applied over the buckle 20 where it maintains the buckle lever 22 in a closed position. The clip 10, when applied, normally exerts a force tending to urge front member 34 toward second member 36, thus tending to urge the buckle lever 22 to remain in a closed position.

It is possible that when the clip 10 is installed, no significant force is applied to the buckle lever 22 unless or until the buckle lever 22 attempts to open. In either case, the clip 10 prevents the unintentional opening of the buckle 20 from occurring.

The lock 74 is then installed as desired to further secure the golf bag 12 in position and to deter theft. To remove the clip 10, the lock 74 is first removed and the clip 10 is pulled up and off of the buckle 20.

It is noted that the inner member 38 is what bears against the buckle lever 22 and keeps it secured in place. The structures of the clip 10, as described herein including the inner member 38, provide an optimum configuration for securing the maximum number of types of golf cart buckles in a closed position.

Having the rear member 36 narrower than the front member 34 provides a configuration that also well accommodates the widest variety of buckle types in use.

The front member 34 provides an uninterrupted planar surface that is exposed to the outside during use. It is possible to use this space for promotional purposes. For example, a business name 78 can be included, as desired. The business name 78 may include a logo or the like, whatever is felt to best identify the source.

As such, businesses may be inclined to supply the clips 10 to the public at low or even at no cost if they can expect to realize a promotional benefit. That benefit may include advertising or, by making the clips available at low or no cost, it may be to foster the good will of the public. If the clip 10 can prevent damage to the golf bag 12 and to the golf clubs 14, and if it can also help to deter their theft, then such a gift might well be favorably received by the grateful public.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A clip for use in retaining a buckle lever in a closed position on a golf cart, comprising:

a substantially U-shaped body including a front member and a rear member that are disposed in a spaced-apart parallel planar relationship with respect to each other; and a top member that is a substantially planar member disposed in a substantially perpendicular orientation intermediate with respect to said front and said rear members and attached thereto and wherein said top member includes a planar shape that is substantially trapezoidal so as to form a wider and a narrower parallel side with respect to each other and wherein said wider parallel side of said top member is attached to said front member and said narrower opposite parallel side of said trapezoid is attached to said rear member; and wherein said clip is formed of a material that is sufficiently flexible so as to permit relative motion to occur between said front member and said rear member sufficient to place and to remove said clip from a position of cooperation with respect to a buckle lever.

2. A clip for use in retaining a buckle lever in a closed position on a golf cart, a buckle lever useful for retaining a golf bag on a golf cart, comprising:

a substantially U-shaped body including a front member and a rear member that are disposed in a substantially parallel spaced-apart planar orientation with respect to each other and a top member that is a substantially planar member disposed in a substantially perpendicular orientation intermediate with respect to said front and said rear members and attached thereto and wherein said top member includes a planar shape that is substantially trapezoidal so as to form a wider and a narrower parallel side with respect to each other and wherein said wider parallel side of said top member is attached to said front member and said narrower opposite parallel side of said trapezoid is attached to said rear member; and wherein said clip is formed of a material that is sufficiently flexible so as to permit relative motion between said front member and said rear member to occur and whereby an end of said front member that is disposed at an opposite end with respect to said top member and an end of said rear member that is disposed at an opposite end with respect to said top member are urged away from each other so that said front member is not disposed in said substantially parallel relationship with respect to said rear member sufficient to place and to remove said clip from a position of cooperation with respect to a buckle lever and when said clip is placed in said position of cooperation with respect to a buckle lever said front member and said rear member are urged back into said substantially parallel relationship with respect to each other as a result of the elastomeric property of said material and a buckle lever is disposed in said clip intermediate said front member and said rear member and wherein said elastomeric property of said material retains a buckle lever in said closed position.

3. The clip of claim 2 wherein said rear member includes a width that is narrower than the width of said front member.

4. The clip of claim 2 wherein said rear member includes a width that is approximately 1.8 inches and a height that is approximately 2.45 inches.

5. The clip of claim 2 wherein said front member includes a width that is approximately 2.2 inches and a height that is approximately 2.45 inches.

6. The clip of claim 2 wherein said front member includes a first lip attached thereto at an end opposite where said top member is attached, said lip projecting toward said rear member in a substantially parallel planar alignment with respect to said top member.

7. The clip of claim 6 wherein said rear member includes a second lip attached thereto at an end opposite where said top member is attached, said second lip projecting toward said front member in a substantially parallel planar alignment with respect to said top member.

8. The clip of claim 7 including a first arcuate member that is attached to said first lip at a flat end thereof and includes an opposite curved end that extends away from said top member and is substantially parallel with respect to said front member.

9. The clip of claim 8 including a second arcuate member that is attached to said second lip at a flat end thereof and includes an opposite second curved end that extends away from said top member and is substantially parallel with respect to said rear member.

10. The clip of claim 9 wherein said curved end includes a first aperture.

11. The clip of claim 10 wherein said second curved end includes a second aperture, said first and second apertures aligning with respect to a longitudinal axis passing through each aperture and adapted for placing a lock therein.

12. The clip of claim 10 wherein said first curved end includes a first tapered edge and said second curved end includes a second tapered edge.

13. The clip of claim 2 including a protrusion attached to said clip, said protrusion adapted to receive a tether.

14. The clip of claim 13 wherein said protrusion is attached to said top member.

15. The clip of claim 13 wherein said tether includes means for attaching said tether to said golf bag.

16. The clip of claim 2 including an inner member that is disposed in a substantially planar spaced-apart orientation with respect to said front member, said inner member further being disposed closest to a side of said front member that faces said rear member.

17. The clip of claim 16 including means for attaching said inner member to said front member.

18. A clip for use in retaining a buckle lever in a closed position on a golf cart, a buckle lever useful for retaining a golf bag on a golf cart, comprising:

a substantially U-shaped body including a front member and a rear member that are disposed in a substantially parallel spaced-apart planar orientation with respect to each other and wherein said rear member includes a width that is narrower than the width of said front member and wherein said rear member includes a width that is approximately 1.8 inches and a height that is approximately 2.45 inches and wherein said front member includes a width that is approximately 2.2 inches and a height that is approximately 2.45 inches, and a top member that is a substantially planar member disposed in a substantially perpendicular orientation intermediate with respect to said front and said rear members and attached thereto and wherein said top member includes a planar shape that is substantially trapezoidal so as to form a wider and a narrower parallel side with respect to each other, and wherein said wider parallel side of said top member is attached to said front member and said narrower opposite parallel side of said trapezoid is attached to said rear member, and wherein said clip is formed of an elastomeric material that is sufficiently flexible so as to permit relative motion to occur between said front member and said rear member, and whereby an end of said front member that is disposed at an opposite end with respect to said top member and an end of said rear member that is disposed at an opposite end with respect to said top member are adapted to be urged away from each other so that said front member is not disposed in said substantially parallel relationship with respect to said rear member a sufficient amount to permit the placement and removal of said clip to and from a position of cooperation with respect to a buckle lever, and when said clip is placed in said position of cooperation with respect to a buckle lever, said front member and said rear member are urged back into said substantially parallel relationship with respect to each other as a result of said elastomeric property of said material whereby a buckle lever is disposed in said clip intermediate said front member and said rear member, and wherein said elastomeric property of said material is adapted to retain a buckle lever in said closed position, and wherein said clip includes means for attaching a tether thereto.

* * * * *